US008096628B2

(12) United States Patent
Ostrowski

(10) Patent No.: US 8,096,628 B2
(45) Date of Patent: Jan. 17, 2012

(54) PIEZO ACTUATED SLIDE LATCHING MECHANISM

(75) Inventor: Eric Allen Ostrowski, La Mesa, CA (US)

(73) Assignee: CareFusion 303, Inc., San Diego, CA (US)

( * ) Notice: Subject to any disclaimer, the term of this patent is extended or adjusted under 35 U.S.C. 154(b) by 0 days.

(21) Appl. No.: 12/893,984

(22) Filed: Sep. 29, 2010

(65) Prior Publication Data

US 2011/0012374 A1 Jan. 20, 2011

Related U.S. Application Data

(63) Continuation of application No. 11/696,092, filed on Apr. 3, 2007, now Pat. No. 7,823,993.

(51) Int. Cl.
*A47B 95/00* (2006.01)

(52) U.S. Cl. ..... 312/333; 312/319.2; 312/334.44

(58) Field of Classification Search ..... 312/333, 312/334.44, 334.46–334.47, 319.1–319.2; 384/21; 292/144, 137
See application file for complete search history.

(56) References Cited

U.S. PATENT DOCUMENTS

| | | | |
|---|---|---|---|
| 4,895,008 | A | 1/1990 | Blake |
| 5,014,875 | A | 5/1991 | McLaughlin et al. |
| 5,087,107 | A | 2/1992 | Fumanelli |
| 6,059,390 | A | 5/2000 | Salomaa |
| 2003/0122519 | A1 | 7/2003 | Huber et al. |
| 2006/0217835 | A1 | 9/2006 | Stobbe |
| 2006/0267461 | A1 | 11/2006 | Hoffman |

FOREIGN PATENT DOCUMENTS

| | | |
|---|---|---|
| DE | 4124512 | 6/1992 |
| GB | 2281937 | 3/1995 |
| WO | WO03087503 | 10/2003 |
| WO | WO2005026479 A1 | 3/2005 |

*Primary Examiner* — Hanh V Tran
(74) *Attorney, Agent, or Firm* — McDermott Will & Emery LLP

(57) ABSTRACT

A latching mechanism is particularly suited for use in latching a slide mechanism, such as used to slidably mount a drawer. The latching mechanism includes a latch assembly comprising a latch lever mounted for movement between a first, second and third positions, a latch tab for selective engagement with a second end of the latch lever, and a piezo electric controller. The controller has a plunger configured to selectively control the movement of the latch lever between the first and second positions, the plunger movable between an extended position corresponding to a first, locked position of the latch lever and a retracted position corresponding to the second, unlocked position of the latch lever, the controller when unpowered preventing the plunger from moving from the extended to the retracted position and the controller when powered permitting the plunger to move from the extended to the retracted position.

13 Claims, 4 Drawing Sheets

PIEZO ACTUATED SLIDE LATCHING MECHANISM

CROSS REFERENCE TO RELATED APPLICATIONS

The present application is a continuation application of U.S. application Ser. No. 11/696,092, filed Apr. 3, 2007, now issued as U.S. Pat. No. 7,823,993, which is incorporated herein by reference.

FIELD OF THE INVENTION

The present invention relates to locking or latching mechanisms and, more particularly, such mechanisms for use in locking or latching a slide, such as used with a drawer.

BACKGROUND OF THE INVENTION

It is often desirable to lock a drawer in its closed position in order to prevent access to the interior thereof. For example, medication, medical devices, or sensitive documents might be stored in the drawer.

A variety of locking or latching mechanisms have been developed for such a purpose. For example, mechanical locks are known which utilize key to rotate a latching member from a retracted position to an extended position in which the member interferes with the movement of the drawer. Some locking mechanisms are electro-mechanical, such as using a motor to move the locking member.

In general, prior drawer locking mechanisms have one or more drawbacks. In some instances, the mechanisms are large and heavy and are not suited use in many environments where such drawers are utilized. Mechanical devices also must be directly operated by the user, preventing their associating with control systems, such as alarm or other systems. Various of the electro-mechanical systems are complex or require that power be provided at all times in order to ensure that the drawer remains locked. In addition, various of these locks can be relatively easily thwarted, such as by application of force, picking the lock or the like.

SUMMARY OF THE INVENTION

In general, the invention is a latching or locking mechanism. The latching mechanism has particular utility in latching a slide mechanism, such as a slide used to facilitate movement of a drawer and having an inner and outer slide. As also detailed herein, the invention can be used in a variety of other applications, such as door access control.

In one embodiment, the latching mechanism includes a latch assembly comprising a latch lever for movement between at least first and second positions, a latch tab for selective engagement with a second end of the latch lever, and a piezo electric controller. The controller has a plunger configured to selectively control the movement of the latch lever between the first and second positions, the plunger movable between an extended position corresponding to a first, locked position of the latch lever and a retracted position corresponding to the second, unlocked position of the latch lever, the controller when unpowered preventing the plunger from moving from the extended to the retracted position and the controller when powered permitting the plunger to move from the extended to the retracted position. In the locked position, the second end of the latch lever prevents the latch tab from moving in a first direction past the latch lever. In the unlocked position, the latch tab is permitted to move past the second end of the latch lever.

In one embodiment, the latch lever is also permitted to move to a third position generally opposite the locked position from the unlocked position. In this position, the second end of the latch lever permits the latch tab to be moved past it in a second direction.

The latch assembly may comprise a bracket rotatably supporting the latch lever and slidably supporting a latch slide. A first end of the latch lever extends through the latch slide, and the plunger is configured to engage an end of the latch slide. A biasing member may bias the first end of the latch lever towards its unlocked position.

In one environment of use, the latch assembly and piezo electric controller are mounted to a first slide of a slide mechanism. In a preferred embodiment, the first slide of the slide mechanism is fixed or non-moving, such by being mounted to a stationary support structure. The latch tab is mounted to a second slide of the slide mechanism. When the first slide is non-moving, the second slide is the moving slide member. The second end of the latch lever extends towards the second slide, and the latch tab extends outwardly towards the latch lever.

In a method of use, movement of a second slide relative to a first slide may be controlled. This method may be used, for example, to control the movement of a drawer in and out of a supporting structure.

Outward movement of the second slide is prevented by engagement of the latch tab with the second end of the latch lever. In particular, in its locked position, the latch lever is prevented from rotating to an unlocked position by the plunger.

When the controller is powered, force applied by the latch tab to the latch lever causes the latch lever to move the plunger inwardly, allowing the latch lever to rotate. When rotated, the latch tab is permitted to pass by the latch lever, allowing the second slide to be extended relative to the first slide.

The latch lever then returns to its locked position and the controller may be again unpowered. The second slide may be extended back into the first slide. In particular, the latch tab causes the latch lever to rotate to a released or third position. This position is generally opposite the locked position from the unlocked position. So rotated, the latch tab is permitted to pass by the latch lever, allowing the second slide to be extended into the first slide. The latch lever then returns to its locked position.

Various objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention is a latching mechanism. The latching mechanism has particular applicability to a slide, such as used to permit movement of a drawer. In general, the latching mechanism comprises a first latching member for selective engagement with a second latching member, and an actuator or controller which selectively controls the first latching member.

The first latching member may comprise a latch assembly associated with an outer slide member. The second latching member may comprise a tab associated with an inner slide member. The controller preferably comprises a piezo electric unit. In use, the controller selectively controls the position of the latch assembly, which in turn selectively engages the latch tab. Depending on the position or condition of the controller and latch assembly, the latch tab is permitted to move relative to the latch assembly, thus determining the extent of movement of the inner slide relative to the outer slide.

Figure 1:
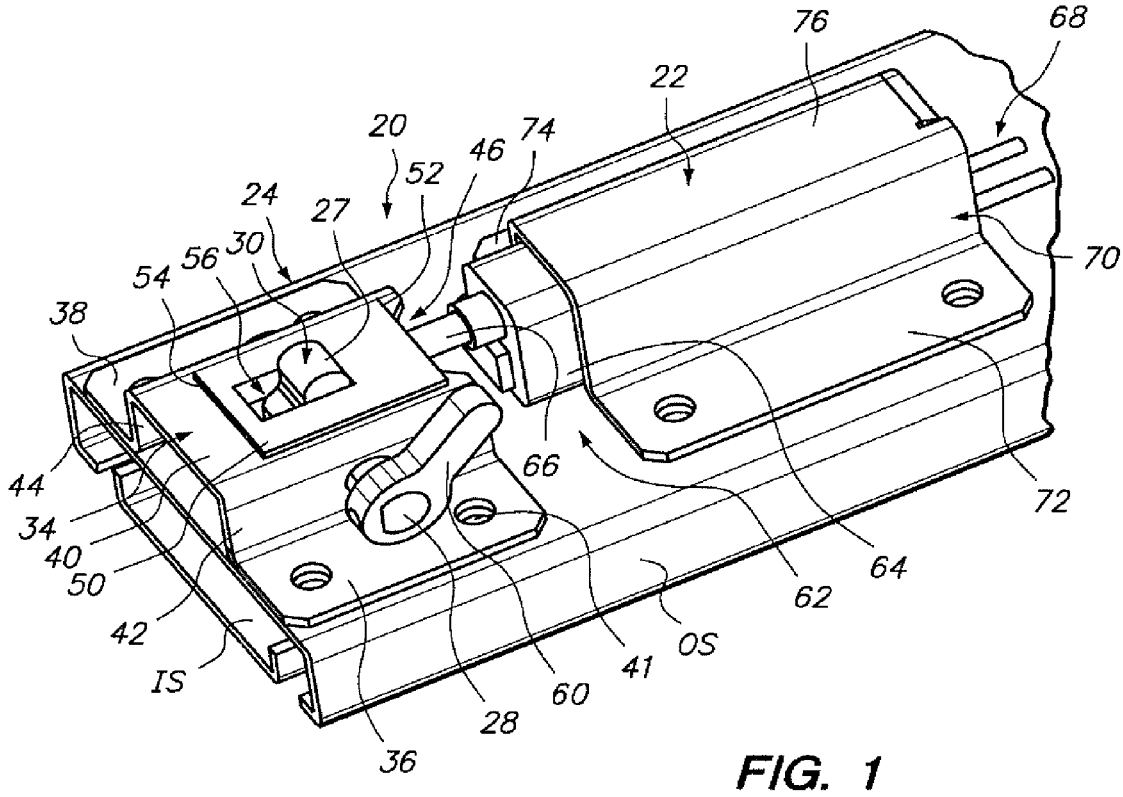
FIG. 1 is a perspective view of a latching mechanism of the present invention as coupled to inner and outer slides of a slide mechanism.

The invention will now be described in greater detail with reference to FIGS. 1-6. Referring to FIG. 1, a latching mechanism 20 comprises a controller 22, a first latching member in the form of a latch assembly 24 and a second latching member in the form of a latch tab 26 (see FIG. 2). In one embodiment, as described in greater detail below, the latching mechanism 20 may be associated with a slide mechanism comprising a first or outer slide member and a second or inner slide member, the inner and outer slides configured to move relative to one another. Generally, one of the slides is fixed or non-moving, such as by attachment to a stationary support structure. The other slide is configured to move. For example, as described in greater detail below relative to FIG. 7, the first slide member may be connected to a cabinet or similar support structure. The second slide member may be connected to a movable member, such as a drawer, whereby the second slide member may be moved relative to the first slide member. It will also be appreciated that the slide mechanism may have a variety of other components, such as an intermediate slide member. As illustrated in FIG. 1, in a preferred embodiment, the latch assembly 24 and controller 22 are associated with the fixed outer slide OS and the latch tab 26 is associated with the movable inner slide IS.

Referring still to FIG. 1, the latch assembly 24 preferably comprises a latch lever 27 that is movable between at least a first and a second position. In one embodiment, the latch lever 27 is mounted for rotation on a shaft 28. A first or top portion or end 30 of the latch lever 27 extends outwardly from the shaft 28 in a first direction. A second or bottom portion or end 32 of the latch lever 27 extends outwardly from the shaft 28 in a second direction (see FIG. 2).

In a preferred embodiment, the shaft 28 is rotatably mounted to a mounting bracket 34. In one embodiment, the mounting bracket 34 has a pair of legs 36,38, and a raised central portion 40 there between. As illustrated, each lea 36,38 preferably comprises a generally planar mounting portion of the mounting bracket 34. These portions of the mounting bracket 34 may be used to mount the mounting bracket 34 to a support. For example, threaded fasteners or the like may be passed through apertures 41 in the legs 36,38, and into engagement with a support, such as the illustrated outer slide OS. Of course, the bracket 34 might be mounted in other manners, such as by welding, adhesive or the use of other types of fasteners.

As indicated, the central portion 40 of the bracket 34 preferably includes at least one portion which is offset or raised from the legs 36,38. As illustrated, the central portion 40 is generally "C" shaped, having support portions 42,44 which extend generally perpendicularly outward from the legs 36,38 to a generally planar portion there between.

In one embodiment, the shaft 28 is supported by the support portions 42,44, whereby the shaft 28 extends generally parallel to a planar face of the outer slide OS to which the latch assembly 24 is mounted. The shaft 28 may be mounted on bearing to facilitate rotation thereof relative to the mounting bracket 34.

In one embodiment, a slot 46 extends into the central portion 40 of the mounting bracket 34. At one or more times, the top end 30 of the latch lever 27 extends though this slot and outwardly of the mounting bracket 34.

On the other hand, the outer slide OS preferably includes a similar slot 48 located beneath the shaft 28. At one or more times, the bottom end 32 of the latch lever 27 extends through this slot and protrudes from a rear side of the outer side OS.

Means are provided for moving the latch lever 27. In one embodiment, this means comprises a latch slide 50. As illustrated, the latch slide 50 is a generally planar plate which is located at a top or outer side (i.e. a side facing away from the outer slide OS) of the central portion 40 of the bracket 34. In one embodiment, the latch slide 50 has a first end 52 and an opposing second end 54 and defines an aperture 56 therein. As detailed below, the latch slide 50 is movably mounted to the mounting bracket 34, thus permitting the latch slide 50 to move linearly back and forth relative to the mounting bracket 34.

As illustrated, the latch slide 50 is configured to engage the top end 30 of the latch lever 27. In one embodiment, the top end 30 of the latch lever 27 extends into the aperture 56 defined by the latch slide 50.

Figure 2:
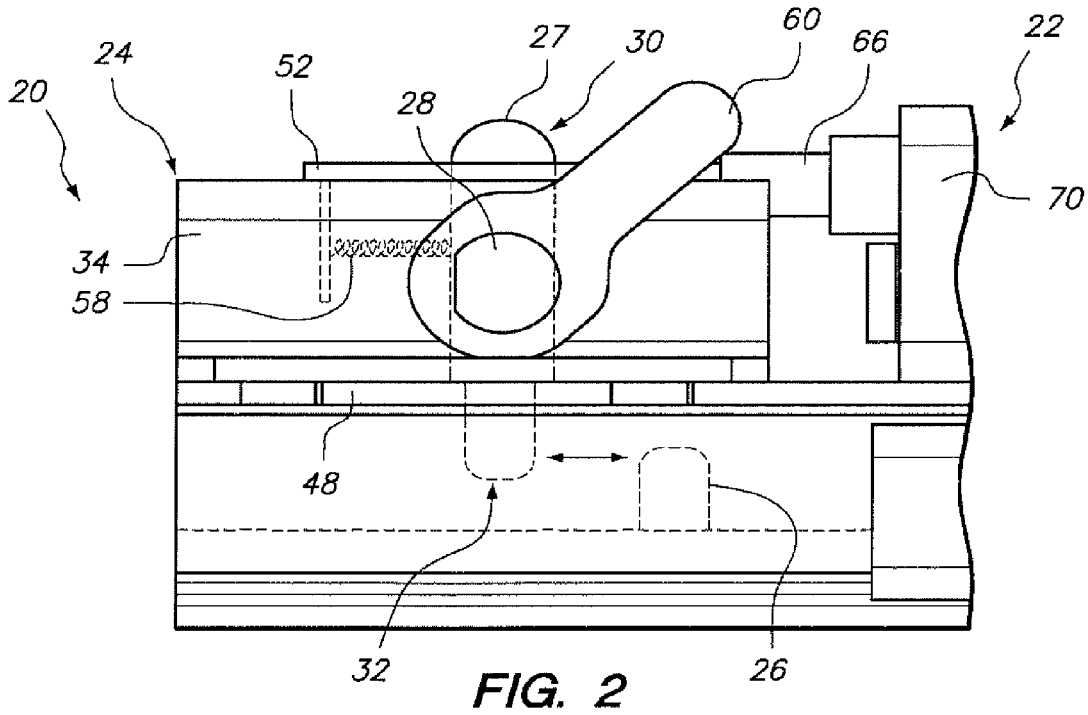
FIG. 2 is a side view of the latching mechanism illustrated in FIG. 1, illustrating a the slides and the latching mechanism in a latched position.

The latch assembly 24 preferably includes means for biasing the latch lever 27 towards the position illustrated in FIG. 1 (as described in more detail below). In one embodiment, as illustrated in FIG. 2, this means comprises a spring 58. The spring 58 may be a coil spring which is positioned between the top portion 30 of the latch lever 27 and a mount or stop portion of the latch slide 50. When considering the orientation illustrated in FIG. 2, the spring 58 is preferably configured to bias the latch lever 27 in a clockwise direction (i.e. bias the latch lever 27 towards the right). Other means may be used to bias the latch lever 27. For example, a plurality of springs, or other compressible members configured to generate a biasing force as are presently known, may be utilized.

In one embodiment, a manual release lever 60 is mounted to the shaft 28. As illustrated, one end of the shaft 28 extends outwardly of the mounting bracket 34. The release lever 60 is mounted on that end of the shaft 28. The release lever 60 may have a variety of configurations. As illustrated the release lever 60 has a mounting portion which includes an aperture or passage for accepting the shaft 28, and an engaging portion extending outwardly there from. Operation of the release lever 60 will be described in more detail below.

The controller 22 is configured to selectively control operation of the latch assembly 24 at one or more times. In a preferred embodiment, the controller 22 selectively controls the movement or position of the latch lever 27 of the latch assembly 24.

In one embodiment, the controller 22 comprises a piezo electric unit or controller 62. In a preferred embodiment, the piezo electric unit 62 comprises a piezo actuator 64 having a plunger or piston 66. Power is selectively provided to the piezo electric unit 62, such as by a pair of electrical leads 68. As detailed below, in a preferred embodiment the plunger 66 of the piezo electric unit 62 is preferably locked when the piezo actuator 64 un-powered, and is moveable when powered. Such a piezo electric unit 62 may be obtained from a commercial source and may thus be pre-manufactured. As illustrated, such a unit 62 may have an outer housing which contains various components thereof, with the plunger 66 extending from that housing.

In one embodiment, the piezo electric unit 62 is configured to be activated with less than 200 mA of power at 200V. In one embodiment, power at this voltage may be provided directly. In another embodiment, power at 12V DC may be converted to 200V DC by a step up transformer.

In one embodiment, when the piezo electric unit 62 is un-powered, the plunger 66 is fixed in an extended position and can with stand an axial load of approximately 1200N (270 lb) or more. When the piezo electric unit 62 is powered, the plunger 66 is preferably permitted to move inwardly to a retracted position (i.e. toward the right in FIG. 2). In one embodiment, the plunger 66 can move approximately 3.7 mm. Further details regarding the manner of operation of the piezo electric unit 62 are provided below.

One embodiment of a controller 62 utilizing a piezo electric unit 62 and meeting these preferred characteristics is a model AL2 unit available from Smocell, Ltd. of Essex, U.K. (distributed in the U.S.A. via APC International, Ltd. of Mackeyville, Pa.).

As illustrated, the piezo electric unit 62 is preferably located adjacent to the latch assembly 24 so that, at one or more times, a free end of the plunger 66 engages the latch slide 50. In the embodiment in which the latch mechanism 20 is associated with a slide, the piezo electric unit 62 is preferably mounted to the outer slide OS. As illustrated, a mounting bracket 70, similar the mounting bracket 34 of the latch assembly 24, may be utilized to mount the piezo electric unit 62. In one embodiment, the mounting bracket 70 has a pair of legs 72,74 which may be connected to the outer slide OS, such as with fasteners. A main portion of the piezo electric unit 62 is mounted beneath a raised central portion 76 of the mounting bracket 70. In this manner, the piezo electric unit 62 is compressed into a fixed position beneath the mounting bracket 70 and against the outer slide OS. Of course, the piezo electric unit 62 might be mounted in other manners, such as with mounting brackets associated directly with a housing thereof.

Referring now to FIG. 2, the latch tab 26 is configured to selectively engage the latch lever 27. When the latching mechanism 20 is utilized with a slide, the latch tab 26 is preferably mounted to the inner slide IS.

As illustrated, the latch tab 26 comprises a prong-like member. The latch tab 26 may, for example, be a metallic prong that extends outwardly from a plate or base which is mounted to the inner slide IS. The latch tab 26 is configured with a height, when considering the size of the latch lever 27, that the latch tab 26 and latch lever 27 will interfere with (i.e. hit) one another when the latch lever 27 is the position illustrated in FIG. 2. In this regard, the latch tab 26 is also mounted in linear alignment with the latch lever 27 so that, at one or more times, the latch tab 26 engages the latch lever 27.

Operation of the latching mechanism of the invention will now be described with reference to FIGS. 2-6. As indicated herein, the latching mechanism may have various configurations. Relative to FIGS. 2-6, the method of operation will be described relative to the particular embodiment just described and illustrated in FIG. 1.

FIG. 2 illustrates the latching mechanism 20 in a locked condition. In this condition, the piezo electric unit 62 is unpowered. The plunger 66 thereof extends outwardly into engagement with the latch slide 50 of the latch assembly 24. Because the piezo electric unit 62 is un-powered, the plunger 66 is prevented from moving inwardly.

As illustrated, in this outward position of the plunger 66, the latch slide 50 of the latch assembly 24 is moved to its left-most position (as illustrated in FIG. 2). In this position, the latch slide 50 presses the latch lever 27 into a generally upright position. This may be referred to as the "latched" or "locked" position. As illustrated, in this position the bottom or second end 32 of the latch lever 27 extends downwardly into the path of the latch tab 26. Thus, movement of the inner slide IS outwardly relative to the outer slide OS (as when opening a drawer connected to the inner slide IS), is limited by contact of the latch tab 26 with the bottom end 30 of the latch lever 27, as illustrated in FIG. 2. Because the latch lever 27 is prevented from rotating clockwise (because of its engagement with the latch slide 50, which is in turn limited from moving by the plunger 66), the latch tab 26 can not move past the latch lever 27. In the event a drawer is attached to the inner slide IS this prevents the drawer from being opened.

Figure 3:
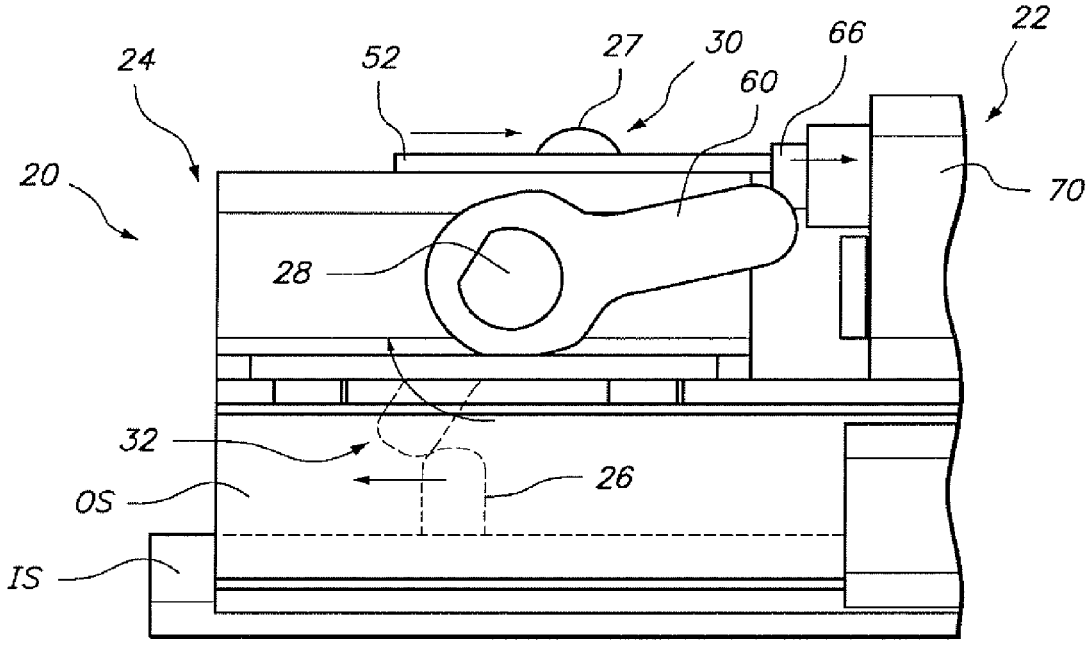
FIG. 3 is a side view of the latching mechanism illustrated in FIG. 1, illustrating the latching mechanism in an unlocked position and the inner slide being moved towards an extended position.

Referring to FIG. 3, when power is provided to the piezo electric unit 62, the plunger 66 is permitted to move inwardly. At that time, if the inner slide IS is moved outwardly relative to the outer slide OS, the latch tab 26 will contact the latch lever 27. Application of sufficient force will cause the latch lever 27 to rotate clockwise, pushing the latch slide 50 to the right and the plunger 66 from its extended position to its retracted position into the piezo electric unit 62. This may be referred to as the "unlocked" position. Upon the latch lever 27 rotating a sufficient degree, the latch tab 26 is permitted to pass there beneath. This allows the inner slide IS to be moved in a first direction to its full extended position relative to the outer slide OS.

Figure 4:
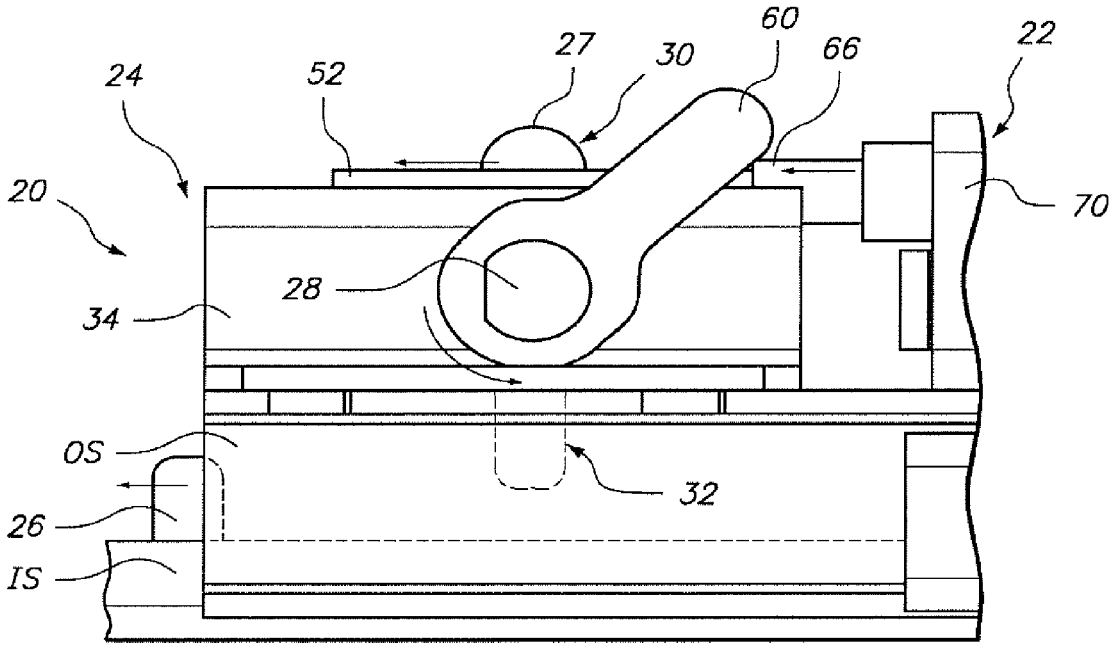
FIG. 4 is a side view of the latching mechanism illustrated in FIG. 1, illustrating the latching mechanism in a locked position after the inner slide has been extended from the outer slide.

As illustrated in FIG. 4, once the latch tab 26 is moved past the latch lever 27, the latch lever 27 is returned to its locked position. At this time, the piezo electric unit 62 is unpowered. Thus, the plunger 66 is moved to its outward and locked position, thus causing the latch slide 50 of the latch assembly 24 to move backs towards the left, thus causing the latch lever 27 to rotate counter-clockwise back to the locked position.

Figure 5:
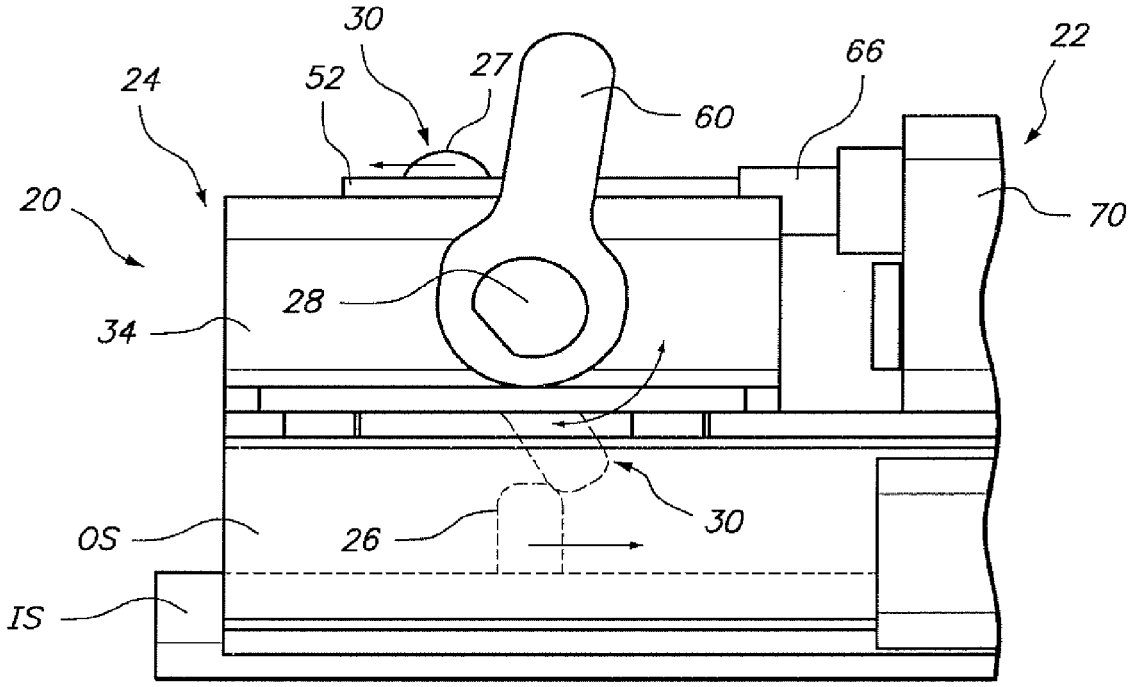
FIG. 5 is a side view of the latching mechanism illustrated in FIG. 1, illustrating the latching mechanism in a released position as the inner slide is being moved back into the outer slide.

Referring to FIG. 5, the inner slide IS may be moved back into the outer slide OS. For example, if a drawer attached to the inner slide IS is closed, the drawer, and thus the attached inner slide IS, is moved inwardly relative to the outer slide OS.

As illustrated, the latch tab 26 is moved to the right and engages the bottom end 32 of the latch lever 27. Upon application of sufficient force, the latch lever 27 is rotated counter-clockwise out of the locked position and into a release position. Referring to FIG. 1, the aperture 56 in the latch slide 50 is sufficiently large to permit this rotation of the latch lever 27. It is noted that this rotation of the latch lever 27 is not inhibited by the piezo electric unit 62, and thus the piezo electric unit 62 need not be powered to permit the inner slide IS to be moved back to the "relatched" position.

In a preferred embodiment, rotation of the latch lever 27 from its locked to its release position is inhibited by the spring 58 which is located between the latching lever 27 and the latch slide 50. This spring 58 is compressed against a stop. Once the latch lever 27 rotates sufficiently, the latch tab 26 is permitted to pass beneath the bottom end 32 thereof. This allows the inner slide IS to be moved in a second directly back to its full retracted position (relative to the outer slide OS).

Figure 6:
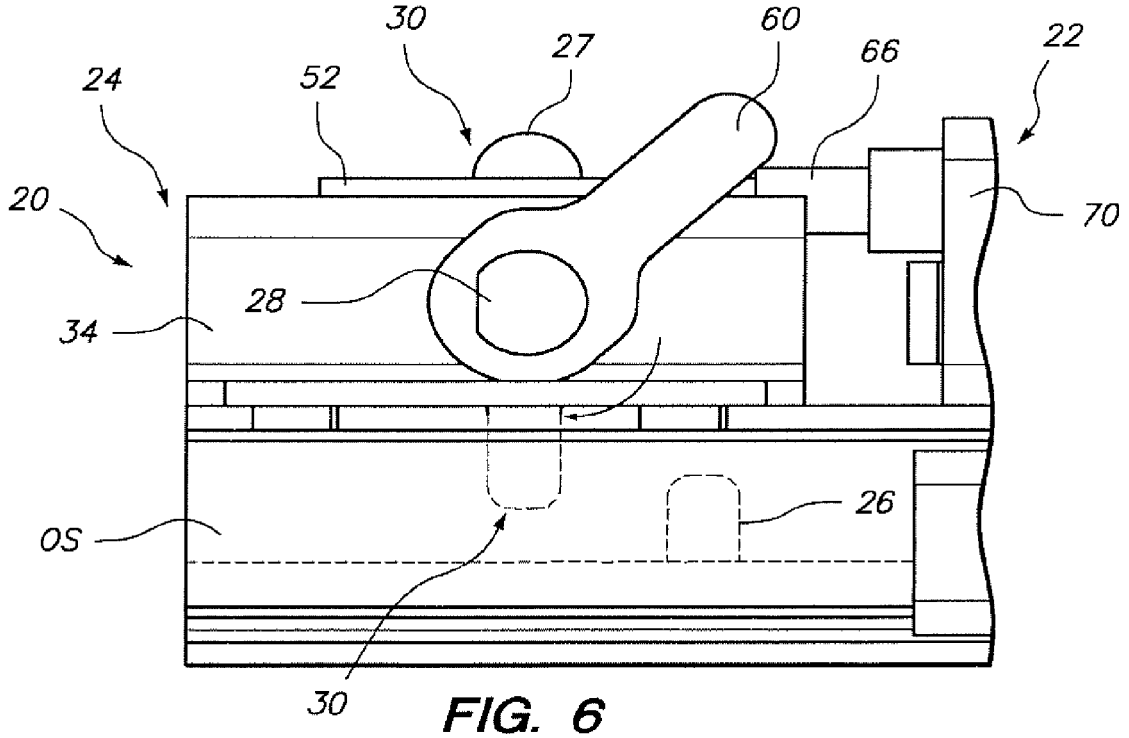
FIG. 6 is a side view of the latching mechanism illustrated in FIG. 1, illustrating the slides and the latching mechanism back in their latched positions.

Referring to FIG. 6, once the latch tab 26 moves past the latch lever 27, the latch lever 27 is returned to its locked position by the spring 58. As indicated relative to FIG. 2, at this time, movement of the inner slide IS outwardly relative to the outer slide OS is limited by contact of the latch tab 26 with the latch lever 27, unless the piezo electric unit 62 is powered. In other words, at that time, the inner slide IS is returned to its "latched" or "locked" position.

The manual release lever 60 may be used to manually release the latching mechanism 20. Referring to FIG. 2, in order to manually release the latching mechanism 20, the user may pull the manual release lever 60 upwardly (i.e. in the counter-clockwise direction in this figure), thus causing the latching lever 27 to move counter-clockwise, into the position illustrated in FIG. 5. While the user maintains the latch lever 27 in that position, the user may move the inner slide IS outwardly, as the latch tab 26 is then permitted to pass under the latching lever 27. Such a procedure might be necessary if, for example, there were a power failure which prevent activation of the piezo electric unit 62.

Figure 7:
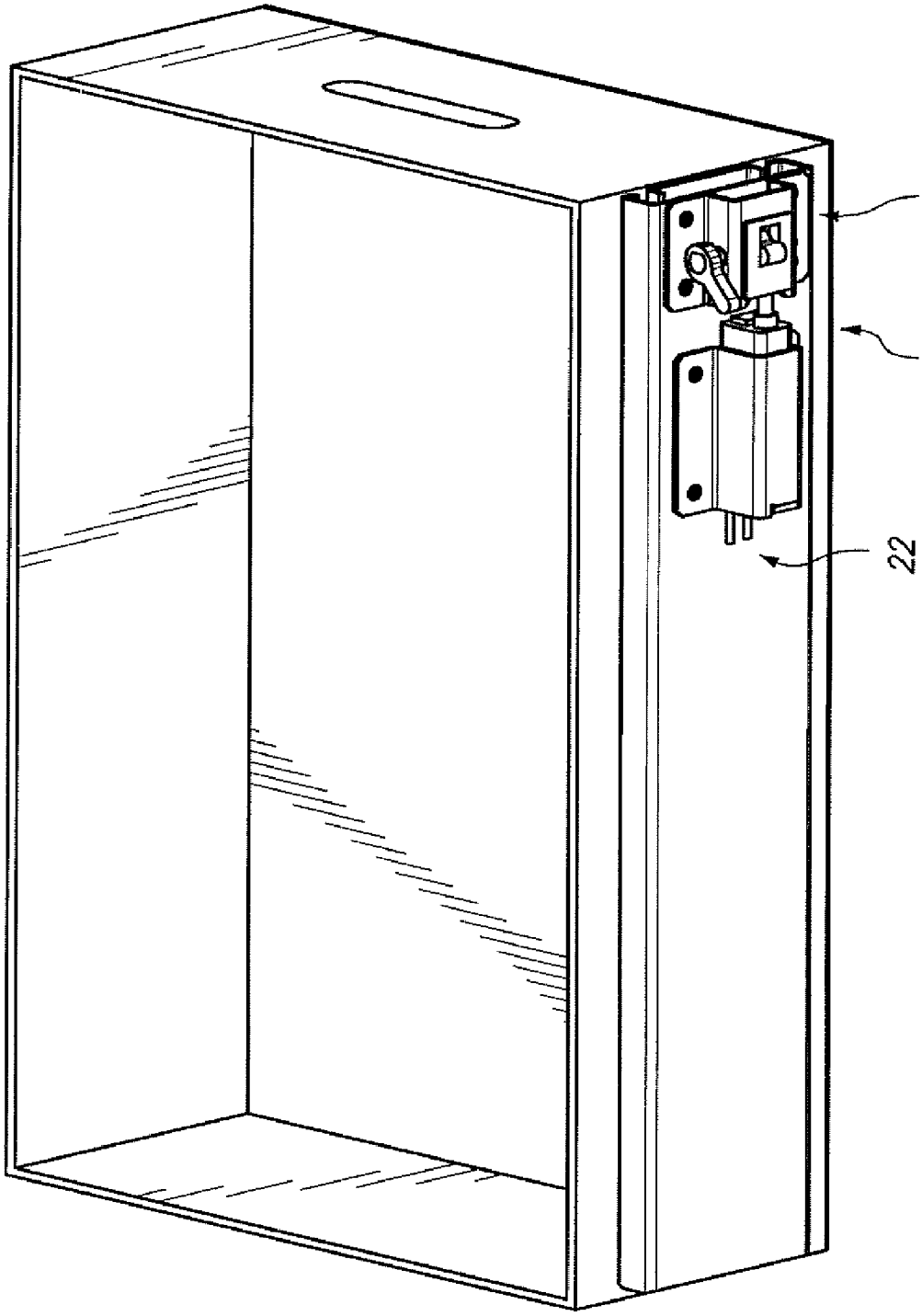
FIG. 7 illustrates the latching mechanism of the invention associated with a slide mechanism coupled to a drawer.

FIG. 7 illustrates the latch mechanism 20 as associated with a drawer D. Generally, the outer slide OS would be mounted to a support structure, such as the inner wall of a cabinet (not shown). The inner slide IS is mounted to an outer side of one of the sides S of the drawer D. Of course, the drawer D is preferably supported by a corresponding pair of slides at the opposing side thereof. However, the latching mechanism 20 need only be associated with one of the pairs of slides in order to lock or latch the drawer D in the manner detailed above. For example, the latch assembly and controller might be mounted to an interior cabinet wall, such as opposite a mounting of the slide assembly, provided that the latch lever can engage the slide assembly from the latch assembly mounting location (such might require providing an access aperture).

The latching mechanism of the invention has particular utility to use with slides, such as used with drawers. However, the latching mechanism may be used in a variety of other applications. For example, the latching mechanism of the invention can be used to control access to a cabinet secured by a door. In one configuration, a door is mounted such that a linking member is connected from a point away from the door's axis of rotation to a point on a slide mechanism or assembly. Door access can be controlled by applying the latch mechanism, including various features and embodiments described herein, to the slide assembly to control movement thereof. The lever arm of the latch mechanism can also be used as a latching feature for a door hasp or to provide control for a latch cam used to capture a door hasp. For example, the latch lever of the latching mechanism might be configured to directly interface with a rotating member which is part of, or associated with, such a door hasp (i.e. the "latch tab" may be associated with the door hasp or comprise a portion thereof, and may have a form which varies from that detailed above). The latch mechanism may be configured to control movement of the latch lever in the above-described manner, thus controlling movement of the rotating member, such as via a detent feature on that member.

Additional features and advantages of the invention will now be described.

It will be noted that the various components of the latching mechanism may have a variety of configurations and may be constructed in a variety of manners. For example, the various components may be constructed of metal or other materials. The components might be constructed by machining, molding or in other manners. Various of the components might be combined. For example, as indicated above, the piezo electric unit might be provided with integrated mounting feet rather than being mounted with a separate bracket.

The components of the latching mechanism could be mounted in other fashions than as illustrated. For example, the latch assembly and controller might be mounted to a cabinet wall, rather than the outer slide. In such a configuration, the brackets could be configured differently to permit such attachment, or the components might be mounted so that the latch lever extends through an opening in a cabinet wall and the outer slide mounted thereto, and into the path of the latch tab.

As indicated above, the plunger of the piezo electric unit is capable of withstanding a very high axial load. In one embodiment, the components of the latching mechanism are capable of withstanding an opening force of 220 lbs or more without unlatching, (i.e. a 220 lb opening force applied to a drawer, pulling the latch tab against the latch lever without permitting the latch tab to pass by the latch lever).

In one embodiment, the plunger of the piezo electric unit is biased outwardly. For example, an internal spring may be utilized to bias the plunger outwardly at a force around 5N (0.221 lbs).

Power may selectively be provided to the piezo electric unit (for allowing the latch lever to be moved from its locked to its unlocked position) in various manners. For example, a switch button may be provided which selectively allows power to pass from a source to the unit. In one embodiment, the switch might be key activated to prevent the unit from being powered without authorization.

Since the latch mechanism requires very low power to operate, it is possible to operate the mechanism using common batteries, such as one or more AA batteries. Such batteries might be used as a backup power source if the latch mechanism is normally powered via a power bus of a larger assembly with which it is associated. The ability to operate the mechanism using such low power requirements is unique to the configuration of the latch mechanism, including the piezo electric controller described herein. In this regard, it is possible to operate the latch mechanism with other types of controllers. For example, a DC motor, solenoid or other controllable actuator, device or mechanism (or combination of elements) which is capable of controlling movement of the plunger in the above-described manner, might be utilized. However, as indicated herein, the use of a piezo electric controller has a number of particular advantages and benefits.

The latching mechanism might also have other configurations. For example, the latch slide might have other configurations than a plate. In one embodiment, the latch slide might be eliminated entirely so that the plunger of the piezo electric unit directly engages the latch lever. The latch assembly need not include a manual release, or might include more than one such release (such as at both ends of the shaft).

In one embodiment, the latch mechanism might include or be used with one or more sensors. The sensors might be associated with the drawer, the slide and/or the latching mechanism to provide feedback to a system controller for monitoring and control of the latching mechanism. For example, the condition of the latching mechanism might be controlled and monitored by a control system. In this configuration, one or more sensors might be utilized to monitor the position of a drawer. Output of the sensors could be provided to the control system, such as for verifying that the drawer is in its closed position, or for verifying that the latch mechanism is in its locked condition. Such sensors might also be used to detect motion of the drawer, such as when the drawer is supposed to be in its locked condition.

The latching mechanism has numerous advantages. As indicated above, the latching mechanism will withstand high loads without unlatching. The latching mechanism is also secure. Advantageously, the latching mechanism is retained in the locked or latched position when no power is provided to the unit. Thus, in the event of a power failure or the like, the latching mechanism remains locked. In addition, the latching mechanism uses very little power, since power only needs to be provided in order to "unlock" the mechanism.

Another advantage is that the latching mechanism can be associated with a slide, rather than just a drawer. This allows the latching mechanism to be located in a more secure and protection position. In addition, this allows the latching mechanism to more effectively prevent movement of the drawer or other object.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A latching mechanism comprising:

a latch lever rotatably coupled to a first slide element , the latch lever having a first, a second, and a third position, wherein the first position is between the second and third positions;

a latch slide coupled to the latch lever, the latch slide configured to selectively move between an open position and a locked position, wherein the latch slide is further configured to allow the latch lever to only move between the first and second positions when the latch slide is in the open position, and to allow the latch lever to move only between the first and third position when the latch slide is in the locked position; and a latch tab fixedly coupled to a second slide element slidably coupled to the first slide element, the latch tab configured to displace the latch lever from the first position toward the second position when the latch tab approaches the latch lever from a first side and to displace the latch lever from the first position toward the third position when the latch tab approaches the latch lever from a second side opposite the first side.

2. The latching mechanism of claim 1, further comprising an actuator coupled to the latch slide, the actuator configured to selectively move the latch slide between the open and locked positions.

3. The latching mechanism of claim 2, wherein the actuator comprises a piezoelectric element.

4. The latching mechanism of claim 2, wherein the actuator comprises a locking element configured to selectively resist movement of the latch slide when the actuator is de-energized.

5. The latching mechanism of claim 4, further comprising a release lever coupled to the latch lever, the release lever configured to move the latch lever to the third position.

6. The latching mechanism of claim 1, further comprising a biasing element that is configured to urge the latch lever toward the first position.

7. The latching mechanism of claim 6, wherein:

when the latch slide is in the open position, the latch tab can move from the first side past the latch lever to the second side but cannot move from the second side past the latch lever to the first side; and when the latch slide is in the locked position, the latch tab cannot move from the first side past the latch lever to the second side but can move from the second side past the latch lever to the first side.

8. A latching mechanism comprising:

a latch lever rotatably coupled to a first slide element;

a latch tab fixedly coupled to a second slide element slidably coupled to the first slide element; and a latch slide slidably coupled to the first slide element, the latch slide configured to selectively move between a locked position and an open position;

wherein the latch slide is configured to:

allow the latch tab to move past the latch lever in a first direction and prevent the latch tab from moving past the latch lever in a second direction that is opposite the first direction when the latch slide is in the open position; and prevent the latch tab from moving past the latch lever in the first direction and allow the latch tab to move past the latch lever in the second direction when the latch slide is in the locked position.

9. The latching mechanism of claim 8, further comprising an actuator coupled to the latch slide, the actuator configured to selectively move the latch slide between the open and locked positions.

10. The latching mechanism of claim 9, wherein the actuator comprises a piezoelectric element.

11. The latching mechanism of claim 9, wherein:

the latch lever has a first position, a second position, and a third position;

the first position of the latch lever is between the second and third positions;

the latch lever can move only between the first and second positions when the latch slide is in the open position; and the latch lever can move only between the first and third positions when the latch slide is in the locked position.

12. The latching mechanism of claim 11, further comprising a biasing element that is configured to urge the latch lever toward the first position.

13. The latching mechanism of claim 12, wherein:

the latch tab can move the latch lever from the first position to the second position when the latch slide is in the open position; and the latch tab can move the latch lever from the first position to the third position when the latch slide is in the locked position.

* * * * *